US011698063B2

(12) United States Patent
Jian et al.

(10) Patent No.: US 11,698,063 B2
(45) Date of Patent: Jul. 11, 2023

(54) HYDRAULIC END ASSEMBLY STRUCTURE OF A PLUNGER PUMP

(71) Applicant: AMERICAN JEREH INTERNATIONAL CORPORATION, Houston, TX (US)

(72) Inventors: Baoguo Jian, Yantai (CN); Haiping Cui, Yantai (CN); Wenping Cui, Yantai (CN); Weichen Liu, Yantai (CN)

(73) Assignee: AMERICAN JEREH INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/874,816

(22) Filed: May 15, 2020

(65) Prior Publication Data

US 2021/0355927 A1 Nov. 18, 2021

(51) Int. Cl.

| | |
|---|---|
| ***F04B 39/10*** | (2006.01) |
| ***F04B 39/12*** | (2006.01) |
| ***F16K 5/04*** | (2006.01) |
| ***F16J 15/06*** | (2006.01) |

(52) U.S. Cl.

CPC ..... *F04B 39/10* (2013.01); *F04B 39/12* (2013.01); *F04B 39/123* (2013.01); *F16J 15/061* (2013.01); *F16J 15/062* (2013.01); *F16K 5/0464* (2013.01); *F16K 5/0471* (2013.01); *F16K 5/0478* (2013.01)

(58) Field of Classification Search

CPC ..... F04B 39/10; F04B 39/123; F16K 5/0464; F16K 5/0471; F16K 5/0478; F16J 15/061; F16J 15/062

See application file for complete search history.

(56) References Cited

U.S. PATENT DOCUMENTS

| | | | | | |
|---|---|---|---|---|---|
| 1,926,413 | A * | 9/1933 | Tibbs | F16K 3/34 | 138/46 |
| 2,023,033 | A * | 12/1935 | Spalding | E21B 33/0422 | 285/123.7 |
| 4,283,062 | A * | 8/1981 | Catanzaro | B29C 45/17 | 277/520 |
| 4,340,204 | A * | 7/1982 | Herd | F16K 3/36 | 251/214 |
| 4,861,241 | A * | 8/1989 | Gamboa | F04B 53/1027 | 417/454 |
| 5,481,197 | A * | 1/1996 | Sanders | F17C 13/021 | 324/690 |
| 6,059,542 | A * | 5/2000 | Chou | F04B 39/123 | 417/360 |

(Continued)

FOREIGN PATENT DOCUMENTS

GB 1068721 A * 5/1967 ..... F16J 15/20

OTHER PUBLICATIONS

"Compression Packing", 2018.*
"Compression Packing", 2018, Fluid Sealing Association,, pp. 83-84.*

*Primary Examiner* — Christopher S Bobish
(74) *Attorney, Agent, or Firm* — Xsensus LLP

(57) ABSTRACT

A hydraulic end assembly structure of a plunger pump, comprising a valve housing assembly, a suction gland and a suction pressing cap. The suction gland is connected to the suction pressing cap, and the suction gland is connected to the valve housing assembly through the suction packing seal assembly.

4 Claims, 2 Drawing Sheets

(56) References Cited

U.S. PATENT DOCUMENTS

| | | | | |
|---|---|---|---|---|
| 7,513,759 | B1 * | 4/2009 | Blume | F04B 53/007 137/512 |
| 7,628,380 | B1 * | 12/2009 | Beaumont | F16K 41/026 251/214 |
| 7,963,502 | B2 * | 6/2011 | Lovell | F16K 41/02 251/214 |
| 8,998,593 | B2 * | 4/2015 | Vicars | F04B 53/007 417/571 |
| 9,249,797 | B2 * | 2/2016 | Byrne | F04B 53/143 |
| 10,837,556 | B2 * | 11/2020 | Chase | F16J 15/18 |
| 2019/0170137 | A1 * | 6/2019 | Chase | F04B 1/0421 |
| 2019/0323608 | A1 * | 10/2019 | Miller | F16J 15/166 |
| 2019/0360483 | A1 * | 11/2019 | Nowell | F04B 1/0448 |
| 2021/0040945 | A1 * | 2/2021 | Hurst | E21B 41/00 |

* cited by examiner

HYDRAULIC END ASSEMBLY STRUCTURE OF A PLUNGER PUMP

TECHNICAL FIELD

The present invention relates to the technical field of plunger pumps, and particularly relates to a new hydraulic end assembly structure of a plunger pump.

BACKGROUND

Hydraulic pressure is the most important technology in oil and gas field exploitation, for which the most critical equipment is a plunger pump. That is, the fracturing base fluid is pressurized by the plunger pump and pumped underground, fracturing the formation at a predetermined depth to exploit shale gas in the formation. The actual pressure that the fracturing base fluid can achieve determines the exploitation depth of an oil and gas well, in other words, whether the formation can be fractured at a predetermined depth.

The current situation of oil and gas field exploitation is developing towards deeper wells. In this industry, a well that reaches a certain depth is called a deep well, a well that is deeper than a deep well is called a high-deep well, and a well that is deeper than a high-deep well is called an ultra-deep well. No matter a deep well, a high-deep well, or an ultra-deep well, there are specific well depth values in the industry. With the emergence of these wells, higher requirements have been put forward for the plunger pump—continuous operation with high pressure and large displacement.

The plunger pump is divided into a power end and a hydraulic end, wherein the hydraulic end will subject to a high pressure and a fluid flushing, and the high and low pressure exchanger in the hydraulic end will be shut off continuously, so that the low pressure liquid can be changed into a high-pressure liquid and discharged (i.e., pressurization of fracturing base fluid). Currently, with the development of the industry, plunger pumps with higher pressure and larger displacement have been developed. At the same, a higher requirement is put forward for the service life of the valve housing at the hydraulic end, which must have the features of high pressure and long service life to meet the requirements of continuous operation of a plunger pump.

For the suction end of conventional hydraulic end assembly, it is common to open sealing grooves on the suction gland or on the valve housing for sealing with 1 or 2 strips of O-ring or D-ring. The O-ring or D-ring is made of NBR materials, its sealing principle is that the sealing ring is extruded and deformed by high pressure to fill the gap to achieve sealing; however, in the operation with high pressure and large displacement, due to long period of cyclic loading, the sealing ring will deform and recover continually, leading to indentations on the surfaces of the valve housing or the suction gland in contact with the O-sealing ring or the D-sealing ring, thus causing the failure of sealing between the suction gland and the valve housing. In severe cases, the high-pressure fluid will form hydraulic cutting to cut the valve housing, causing the abandonment of the valve housing, not only greatly reducing the service life of the valve housing at the hydraulic end, meanwhile causing great hidden dangers.

Therefore, there is an urgent need for a new hydraulic end assembly to meet the requirement for the continuous operation of a plunger pump with high pressure and large displacement.

SUMMARY

To overcome the deficiencies in the prior art, the present invention aims to provide a new hydraulic end assembly structure of a plunger pump, in which the sealing form of O-ring or D-ring in the prior art is replaced by the suction packing seal assembly between the suction gland and the valve housing, which has a good sealability, more resistant to high pressure and fluid flushing, can meet the requirement for the current continuous operation with high pressure and large displacement, and can reduce the abrasion of the suction gland or/and the valve housing, and can further effectively prolong the service life of the suction gland or/and the valve housing.

The objective of the present invention is achieved by the following technical measures: A new hydraulic end assembly structure of a plunger pump, including a valve housing assembly, a suction gland and a suction pressing cap, the suction gland is connected to the suction pressing cap, the suction gland is connected to the valve housing assembly through the suction packing seal assembly.

Further, the suction packing seal assembly includes a support ring, a soft packing, a hard packing and a packing junk ring which are connected successively, the packing junk ring is located at an end near the suction pressing cap, and the support ring is located at an end far from the suction pressing cap.

Further, the valve housing assembly includes a valve spring seat cover, a valve spring seat, a valve spring, a valve body assembly and a valve seat assembly which are connected successively, the valve spring seat cover is used to limit the suction packing seal assembly.

Further, the valve housing assembly is provided with a limit block which is used to limit the suction packing seal assembly.

Compared with the prior art, the present invention has the following beneficial effects: the sealing form of O-ring or D-ring in the prior art is replaced by the suction packing seal assembly between the suction gland and the valve housing; there is no need to open grooves for filling the O-ring or D-ring in the processing of the suction gland or the valve housing; good sealability; in view of the current continuous operation with high pressure and large displacement, in the actual use of the hydraulic end assembly, the sealing of the suction gland by the suction packing seal assembly can meet the sealing requirements under the current increasing pressure and fluid flushing more, compared with the O-ring or D-ring; reducing the abrasion of the suction gland or/and the valve housing; further effectively prolonging the service life of the suction gland or/and the valve housing.

The present invention will be described in detail below with reference to the accompanying drawings and specific implementations.

Wherein, 1. valve housing, 2. suction gland, 3. suction pressing cap, 4. suction packing seal assembly, 5. valve spring seat cover, 6. valve spring seat, 7. valve spring, 8. valve body assembly, 9. valve seat assembly, 10. O-ring, 11. discharge gland, 12. discharge pressing cap, 13. check ring,

14. hoop, 15. plunger, 16. packing pressing cap, 17. plunger packing seal assembly, 18. support ring, 19. soft packing, 20. hard packing, 21. packing junk ring.

DESCRIPTION OF THE EMBODIMENTS

Figure 1:
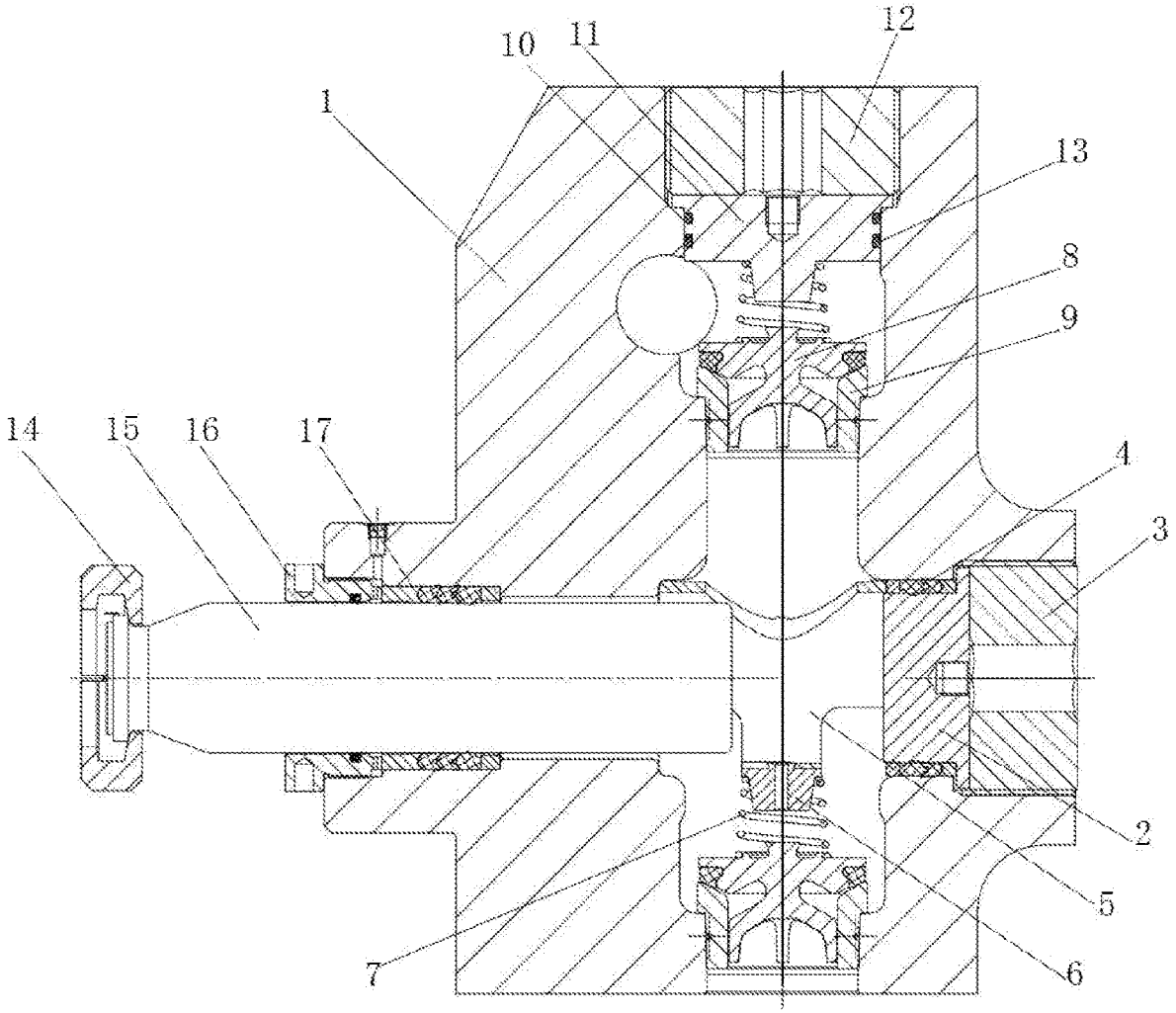
FIG. 1 is a schematic structural diagram of a hydraulic end assembly structure of a plunger pump according to an embodiment of the invention.
Figure 2:
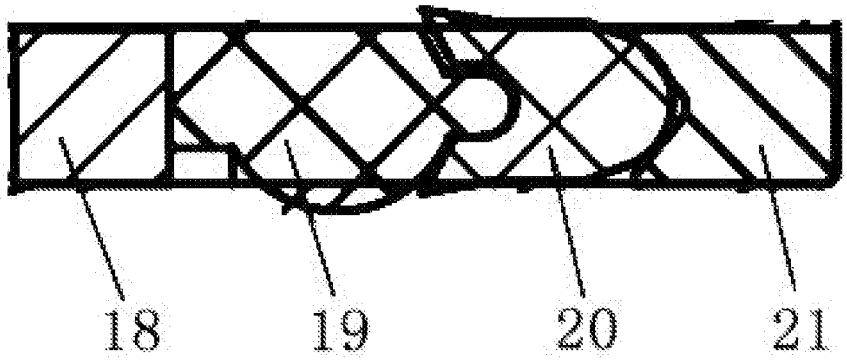
FIG. 2 is a schematic structural diagram of a suction packing seal assembly according to an embodiment of the invention.

As shown in FIGS. 1 to 2, a new hydraulic end assembly structure of a plunger pump, comprising a valve housing assembly, a suction gland 2 and a suction pressing cap 3, the suction gland 2 is connected to the suction pressing cap 3, the suction gland 2 is connected to the valve housing assembly through the suction packing seal assembly 4 tightly. The sealing form of O-ring or D-ring in the prior art is replaced by the suction packing seal assembly 4 between the suction gland 2 and the valve housing 1, and there is no need to open grooves for filling the O-ring or D-ring in the processing of the suction gland 2 or the valve housing 1; good sealability; in view of the current continuous operation with high pressure and large displacement, in the actual use of the hydraulic end assembly, the sealing of the suction gland 2 by the suction packing seal assembly 4 can meet the sealing requirement under the current increasing pressure and fluid flushing more, compared with the O-ring or D-ring; reducing the abrasion of the suction gland 2 or/and the valve housing 1; further effectively prolonging the service life of the suction gland 2 or/and the valve housing 1. For the sealing form of O-ring or D-ring, it is common to open sealing grooves on the suction gland 2, at which case the abrasion of the valve housing 1 is greater than that of the suction gland 2 during the actual use; in turn, if the grooves are opened on the valve housing 1, the abrasion of the suction gland 2 is greater than that of the valve housing 1. However, wherever the grooves are opened, the only difference is to replace the suction gland 2 first or to replace the valve housing 1 first, it cannot fundamentally prolong the service life of the hydraulic end assembly in view of the current operation with high pressure and large displacement. That is, it is impossible to guarantee the continuous operation of the plunger pump under the above conditions.

The suction packing seal assembly 4 includes a support ring 18, a soft packing 19, a hard packing 20 and a packing junk ring 21 which are connected successively, the packing junk ring 21 is located at an end near the suction pressing cap 3, the support ring 18 is located at an end far from the suction pressing cap 3. Into the suction end of the valve housing assembly is put the suction packing seal assembly 4 (successively putting the support ring 18, the soft packing 19, the hard packing 20 and the packing junk ring 21), the suction gland 2 is inserted into the suction packing seal assembly 4, then the suction pressing cap 3 is tightened to compress the suction packing seal assembly 4 tightly, thus achieving the sealing between the valve housing assembly and the suction gland 2.

The valve housing assembly includes a valve spring seat cover 5, a valve spring seat 6, a valve spring 7, a valve body assembly 8 and a valve seat assembly 9 which are connected successively, and the valve spring seat cover 5 is used to limit the suction packing seal assembly 4. The valve housing assembly is provided with a limit block which is used to limit the suction packing seal assembly 4. No matter the limit of the valve spring seat cover 5 or the limit of the limit block, what is limited is the support ring 18. Of course, the limit of the valve spring seat cover 5 or the limit of the limit block are two different limit embodiments for the support ring 18, which are alternative and do not exist at the same time.

The valve housing assembly further includes a valve housing 1, an O-ring 10, a discharge gland 11, a discharge pressing cap 12, a check ring 13, a hoop 14, a plunger 15, a packing pressing cap 16, and a plunger packing seal assembly 17. The discharge gland 11 is located at the discharge end of the hydraulic end assembly. The discharge gland 11 is connected to the valve housing 1 through the O-ring 10 and the check ring 13. The discharge pressing cap 12 compresses the discharge gland 11 tightly. One end of the plunger 15 is connected to the hoop 14, and the other end of the plunger 15 is connected to the valve housing 1 tightly through the plunger packing seal assembly 17. The packing pressing cap 16 is used to fix the plunger packing seal assembly 17, which may also be sealed in other forms of the prior art, for example, being sealed with an O-ring or a D-ring.

It will be appreciated to persons skilled in the art that the present invention is not limited to the foregoing embodiments, which together with the context described in the specification are only used to illustrate the principle of the present invention. Various changes and improvements may be made to the invention without departing from the spirit and scope of the invention. All these changes and improvements shall fall within the protection scope of the invention, which is defined by the appended claims and equivalents thereof.

What is claimed is:

1. A hydraulic end assembly structure of a plunger pump, comprising a valve housing assembly, a suction gland and a suction pressing cap, the suction gland is connected to the suction pressing cap, the suction gland is connected to the valve housing assembly through a suction packing seal assembly without opening a groove on a surface of the suction gland, wherein the suction packing seal assembly comprises a support ring, a soft packing, a hard packing and a packing junk ring which are connected successively, the packing junk ring is located at an end near the suction pressing cap, and the support ring is located at an end far from the suction pressing cap, an inner surface of the support ring is in direct contact with the surface of the suction gland and the suction packing seal assembly covers more than one half of the surface of the suction gland, and the valve housing assembly includes a valve spring seat cover, which is directly connected to a valve spring seat on a valve spring, and the valve spring seat cover limits the suction packing assembly.

2. The hydraulic end assembly structure of a plunger pump according to claim 1, wherein the valve housing assembly comprises a valve body assembly and a valve seat assembly which are connected successively.

3. The hydraulic end assembly structure of a plunger pump according to claim 1, wherein an end of the hard packing ring is in a form of convex shape fitted into a concave surface at an end of the packing junk ring.

4. The hydraulic end assembly structure of a plunger pump according to claim 1, wherein the plunger is connected to the valve housing through a plunger packing seal assembly.

* * * * *